United States Patent [19]

Walther

[11] Patent Number: 4,473,072

[45] Date of Patent: Sep. 25, 1984

[54] READY USE RESPIRATOR

[75] Inventor: Hans-Joachim Walther, Lübeck, Fed. Rep. of Germany

[73] Assignee: Drägerwerk Aktiengesellschaft, Fed. Rep. of Germany

[21] Appl. No.: 448,334

[22] Filed: Dec. 9, 1982

[30] Foreign Application Priority Data

Feb. 23, 1982 [DE] Fed. Rep. of Germany ..... 3206484

[51] Int. Cl.[3] ..... A62B 7/10

[52] U.S. Cl. ..... 128/201.25; 128/202.13; 128/206.12; 206/627

[58] Field of Search ..... 128/202.13, 201.25, 128/206.12; 206/627, 628, 632, 633

[56] References Cited

U.S. PATENT DOCUMENTS 3,535,409 10/1970 Rohde ..... 206/627

3,556,292 1/1971 Krzyzanowski ..... 206/627

FOREIGN PATENT DOCUMENTS 2114584 10/1971 Fed. Rep. of Germany ..... 128/202.13

1323477 2/1963 France ..... 128/202.13

*Primary Examiner*—Henry J. Recla

*Attorney, Agent, or Firm*—McGlew and Tuttle

[57] ABSTRACT

A respirator package comprises a half mask adapted to be worn over a wearer's nose and mouth and having a breathing opening with a filter positioned in the opening and a packing bag enclosing the filter and extending through the half mask having an end portion extending beyond each side of the mask which is closed but has a cut in marking forming a tear-off adjacent each end with a grasping element located adjacent the marking for tearing open the bag. The elements are connected to parts of a folded hood so that unfolding the hood tears the tear-offs.

4 Claims, 2 Drawing Figures

READY USE RESPIRATOR

FIELD AND BACKGROUND OF THE INVENTION

This invention relates in general to respirators and in particular to a new and useful respirator which has a filter packaged in a bag attached to the respirator and which bag has tear-off markings thereon for facilitating the easy removal of the filter when the respirator is to be used.

It is well known that people are injured in fires, e.g. in hotels. They can find no respirator that can be attached even by unskilled persons, and performs its protective function for all head sizes, spectacle wearers and people with all kinds of beards.

A known escape filter device with a hood has a breathing connection in the form of a half mask worked tightly into the hood. This half mask is received by a breathing filter in the form of a CO-filter. It is arranged with its supply air opening outside, and the inspiration opening inside the breathing connection. The supply air and inspiration openings are closed in a stand-by position by plugs. During this stand-by position, the device is arranged ina container consisting of a rear wall and a cover. The plug for the supply air opening is secured on the inside of the rear wall, and the plug for the inspiration opening on the inside of the hood over a band. By removing the escape filter device from the container, the breathing filter is removed from the plug on the rear wall and the supply air opening is thus opened, and when the hood is opened for attaching on the head, the plug is also removed from the inspiration opening. For the wearer, the plug hanging inside the hood on the tape may perhaps be annoying. For the total installation depth of the breathing filter, the plugs are extremely unfavorable. The bulky container for this device results from its total construction (German Utility Model No. 80 15 449).

SUMMARY OF THE INVENTION

The invention provides a non-bulky respirator with hood, whose filter is closed in stand-by position, but opened for breathing when the hood is deployed for use.

In accordance with the invention a respirator comprises a half mask which is adapted to be worn over a wearer's nose and mouth and which has a breathing opening with a filter positioned in the opening. The filter is in a packing bag which extends in the half mask and has an end portion extending beyond each side of the mask which is closed but has a cut-in marking forming a tear off adjacent each end and further arresting elements engageable to facilitate the tearing open of the bag and the ready use of the respirator. The respirator has a folded hood connected to the arresting elements.

Respirators with hoods serve substantially as rescue apparatus, such as escape devices. They must be readily reachable and attachable even by unskilled persons. The respirator according to the invention meets this function in an excellent manner. It is very light in construction, and can be visibly accommodated. It only has to be clearly suspended in an outer bag. The breathing filter arranged in its packing bag and positioned in the half mask is thus so positively closed that it is available ready to use in case of a disaster. By unfolding the hood, the breathing filter opens automatically. Use with an accidentially closed filter is not possible.

The various mounts on the packing bag and the hood ensure the proper installation of the breathing filter. It can thus not be inserted the wrong way. Replacement of the breathing filter may be necessary, e.g. after drills with the respirator.

Accordingly it is an object of the invention to provide a ready use respirator which has a filter packed in a bag which may be easily torn open to release the respirator and the filter.

A further object of the invention is to provide a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 2:
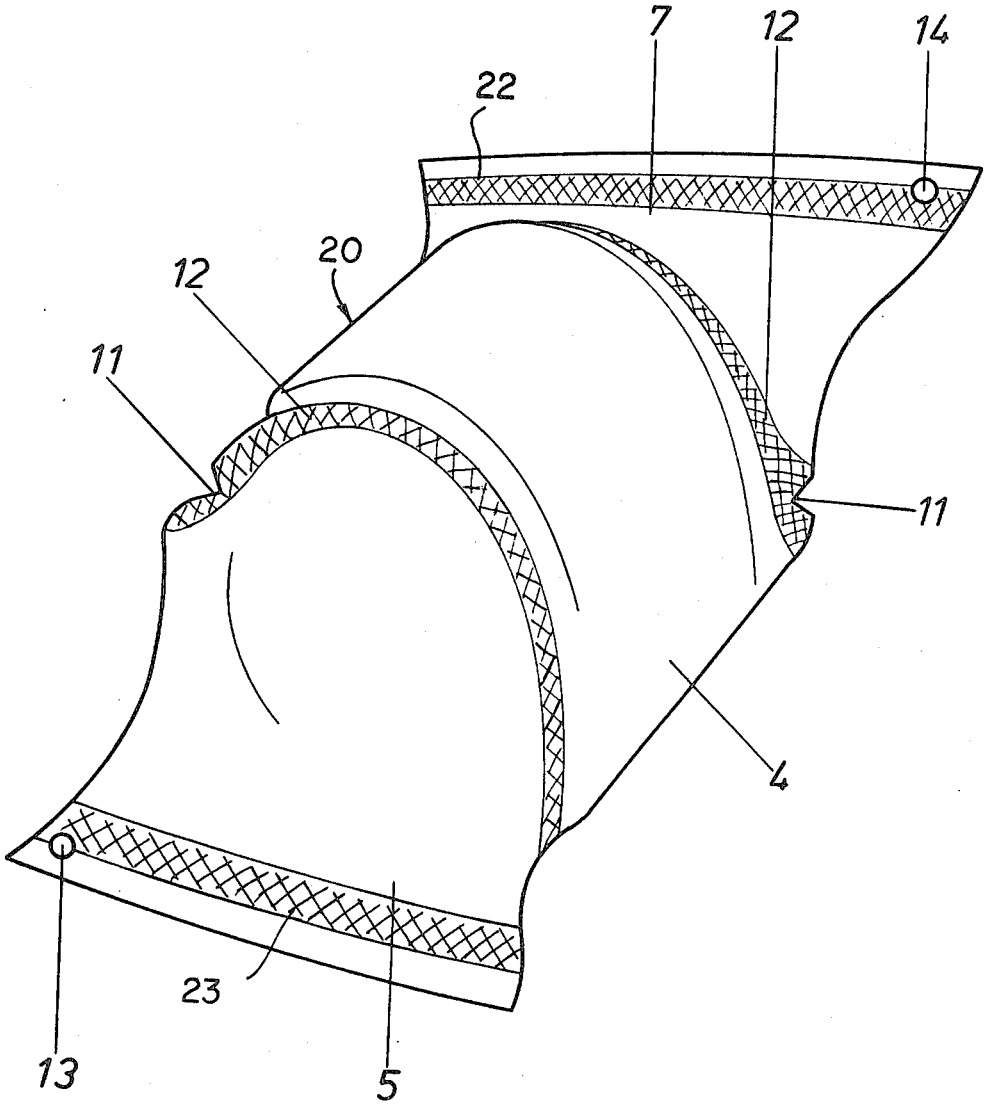
FIG. 2 is a top perspective view of a filter package enclosing the filter alone.

Referring to the drawings in particular the invention embodied therein comprises a respirator generally designated 20 which comprises a half mask adapted to be worn over a user's nose and mouth which has a breathing opening in its front in which a filter 3 is clamped. The construction includes a packing bag enclosing the filter which has an end portion extending beyond each side of the filter as shown in FIG. 2 which are closed and which include means defining a cut-in marking 11 defining a tear off 22 and 23 at each end. Means defining a grasping or attachment element 13 and 14 are provided at each end to facilitate the opening of the bag by tearing off the tear off portion.

A respirator consists of a breathing connection 9 of half mask 1, tightly inserted into a hood 2. The breathing filter 3 is inserted into connection 9 of half mask 1. Breathing filter 3 is packed in a tubular packing bag 4, which is tightly welded at its bag end 5, opposite the air inlet side 6, and at its bag end 7, opposite the air outlet side 8 of breathing filter 3.

In filter mount 9 of half mask 1, breating filter 3 is secured by means of a clamp 10. A spent breathing filter 3 is replaced after loosening clamp 10, by a new, tightly packed filter and clamped again.

Packaging bag 4 has cut-in markings 11 and continuous separating lines 12 for tearing off bag ends 5 and 7. In the inserted state, bag ends 5 and 7 are secured on the folded hood 2 by mounts or fasteners 13, 14. The upper mount 13 is secured on the folded upper part of hood 2, and the lower mount 14 is secured on the turned-in neck closing part or collar 15.

For attaching the hood 2, the bag ends 5 and 7 are thus in any way torn off in the respective directions 16 and 17 when the hood is unfolded. Hood 2, and therefore the respirator can thus only be used with the breathing filter 3 open.

Respirators with hoods according to the invention are used as rescue apparatus, e.g. as escape devices. To this end they must be operable in case of need and be attachable and usable even by unskilled persons.

Figure 1:
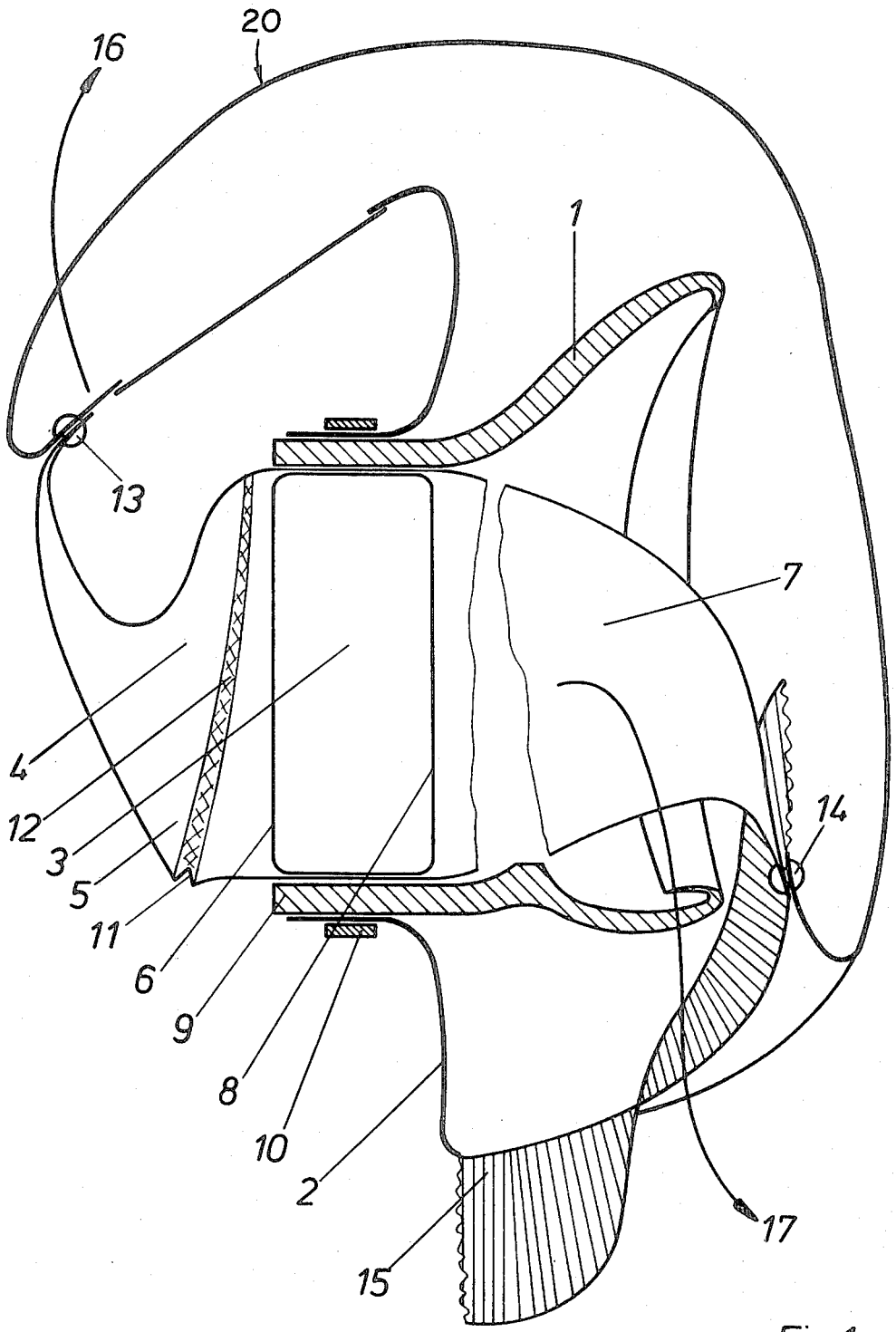
FIG. 1 is a side elvational view partly in section showing the respirator enclosed in a hood or bag in accordance with the invention.

As shown in FIG. 1, with hood 2 in its folded position, the upper portion of the hood is folded down near the filter and is connected to the end 5 of the bag by attachment element 13. The collar 15 is turned in and thus is also closer to the filter than it would be in its unfolded position. The folded in collar is connected at attachment 14 to the other end 7 of the bag 4.

The act of unfolding the hood thus automatically tears the separating lines 12 on either side of the filter, automatically releasing the filter for use.

While specific embodiments of the invention have been shown and described in detail to illustrate the application of the principles of the invention, it will be understood that the invention amy be embodied otherwise without departing from such principles.

What is claimed is:

1. A respirator comprising:

a half mask adapted to be worn over a wearer's nose and mouth, said half mask having a breathing opening therethrough;

a filter disposed in said breathing opening;

a packing bag enclosing said filter engaged around said filter in said breathing opening, said bag having a first sealed end portion extending from one side of said opening and said mask and a second sealed end portion extending from an opposite side of said breathing opening and mask, said bag including first tear means between said first sealing end portion and said filter and second tear means between said second sealing end portion and said filter, said first and second tear means comprising areas where said packing bag can be readily torn open;

a hood connected to said mask having an upper portion lying near said filter in a folded position of said hood and a collar portion lying near said filter in a turned in position of said hood, said hood being movable into an unfolded position with said upper portion and said collar disposed away from said filter;

first attachment means connecting said upper portion of said hood in its folded position to said first sealed end portion; and second attachment means connecting said collar of hood to said second sealed end portion whereby movement of said folded hood into its unfolded position tears said first and second tear means to expose said filter.

2. A respirator according to claim 1, wherein said first and second tear means each comprise a cut-in marking and a tear-off line in said packing bag.

3. A respirator according to claim 2, including clamp means engaged around said mask over said breathing opening and over said enclosed filter for holding said filter in said breathing opening.

4. A respirator according to claim 3, wherein said clamping means is engaged around a portion of said hood for holding said hood to said mask.

* * * * *